US010577146B2

(12) United States Patent
McKewon

(10) Patent No.: US 10,577,146 B2
(45) Date of Patent: Mar. 3, 2020

(54) OVERBOX PACKAGING SYSTEM

(71) Applicant: Proxibid, Inc., Omaha, NE (US)

(72) Inventor: Casey Christopher McKewon, Sioux City, IA (US)

( * ) Notice: Subject to any disclaimer, the term of this patent is extended or adjusted under 35 U.S.C. 154(b) by 28 days.

(21) Appl. No.: 15/942,457

(22) Filed: Mar. 31, 2018

(65) Prior Publication Data

US 2018/0282015 A1 Oct. 4, 2018

Related U.S. Application Data

(60) Provisional application No. 62/479,454, filed on Mar. 31, 2017.

(51) Int. Cl.

| | |
|---|---|
| ***B65D 5/50*** | (2006.01) |
| ***B65D 5/355*** | (2006.01) |
| ***B65D 5/70*** | (2006.01) |
| ***B65D 81/05*** | (2006.01) |

(52) U.S. Cl.

CPC ..... *B65D 5/5023* (2013.01); *B65D 5/0005* (2013.01); *B65D 5/70* (2013.01); *B65D 81/051* (2013.01)

(58) Field of Classification Search

CPC ..... B65D 5/00; B65D 5/0005; B65D 5/50; B65D 5/5023; B65D 5/509; B65D 5/70; B65D 81/05; B65D 81/051; B65D 81/055; B65D 81/057; B65D 81/113

USPC ..... 206/453, 586; 229/117.16

See application file for complete search history.

(56) References Cited

U.S. PATENT DOCUMENTS

| | | | | | |
|---|---|---|---|---|---|
| 2,805,810 | A * | 9/1957 | Butz | B65D 81/055 | 206/453 |
| 3,302,782 | A * | 2/1967 | Pezely, Jr. | B65D 81/057 | 206/453 |
| 3,308,941 | A * | 3/1967 | Kean, Sr. | B65D 85/48 | 206/453 |
| 3,314,584 | A * | 4/1967 | Knapp | B65D 81/057 | 206/586 |
| 3,404,826 | A * | 10/1968 | Carmody | B65D 81/113 | 206/523 |
| 3,425,544 | A * | 2/1969 | Ayer | B65D 71/10 | 229/117.16 |

(Continued)

OTHER PUBLICATIONS

ISTA, Packaged-Products for Parcel Delivery System Shipment, ISTA 3A 2008, pp. 1-8, Jan. 2016, Retrieved from https://www.ista.org/forms/3Aoverview.pdf on Mar. 25, 2017.

*Primary Examiner* — Byron P Gehman

(74) *Attorney, Agent, or Firm* — Young's Patent Services; Bruce A Young

(57) ABSTRACT

An overbox packaging system for a high aspect ratio inner box includes an outer box, at least four modular packaging inserts, and tape to seal the outer box closed. Four modular packaging inserts are adapted to a width of the high aspect ratio inner box by selective removal of zero or more first tear-away pieces and are adapted to a difference in a second dimension of the outer box in the inner box by selective removal of zero or more second tear-away pieces of at least two of the four modular packaging inserts. A second module of additional modular packaging inserts is removed, leaving a first module which is adapted to the width of the high aspect ratio inner box by selective removal of zero or more first tear-away pieces and placed in the outer box with its slot holding a section of the inner box.

8 Claims, 6 Drawing Sheets

(56) References Cited

U.S. PATENT DOCUMENTS

| | | | | |
|---|---|---|---|---|
| 3,531,040 | A * | 9/1970 | Myny | B65D 81/107 206/586 |
| 4,240,240 | A | 12/1980 | Cohen | |
| 6,167,790 | B1 | 1/2001 | Bambara et al. | |
| 6,382,422 | B1 * | 5/2002 | Bocek | B65D 81/113 206/586 |
| 6,508,362 | B2 | 1/2003 | Hnatow et al. | |
| 6,666,334 | B2 * | 12/2003 | Fujii | B65D 5/5033 206/453 |
| 7,654,391 | B2 * | 2/2010 | Langer | B65D 81/113 206/586 |
| 2003/0019779 | A1 | 1/2003 | Horbal | |

* cited by examiner

OVERBOX PACKAGING SYSTEM

CROSS-REFERENCE TO RELATED APPLICATIONS

This application claims benefit of U.S. provisional Patent Application No. 62/479,454, filed on Mar. 31, 2017, the entire disclosure of which incorporated by reference herein for any and all purposes.

BACKGROUND

Technical Field

The present subject matter relates to a system for packaging a box within a larger box for shipping.

Background Art

Many things are packaged for delivery to retail in bulk in such a way that can protect the contents during shipping by such methods. Those same packages, however, may not be suitable for shipping individually by carriers such as United Parcel Service®, Federal Express®, or the United States Postal Service®, allowing their contents to be damaged during shipment.

One solution to this problem is to provide different packaging for the contents with adequate protection for such shipping methods. This is inconvenient for consumers or businesses shipping those products individually, and may require creation of complex packaging material to handle the irregular shapes of the items being shipped.

Another solution is to package the retail box in another, larger, box, with padding between the two boxes, such as shipping peanuts, foam inserts, wadded paper, or bubble-wrap. As long as enough space is left between the two boxes and an adequate amount of padding is provided, this can be a safe way to ship products. But creating such overbox solutions that are optimized to reduce the shipping cost by using a minimum sized box and adequate packing material can lead to a large number of individually designed packages.

BRIEF DESCRIPTION OF THE DRAWINGS

The accompanying drawings, which are incorporated in and constitute part of the specification, illustrate various embodiments. Together with the general description, the drawings serve to explain various principles. In the drawings.

DETAILED DESCRIPTION

Figure 1:
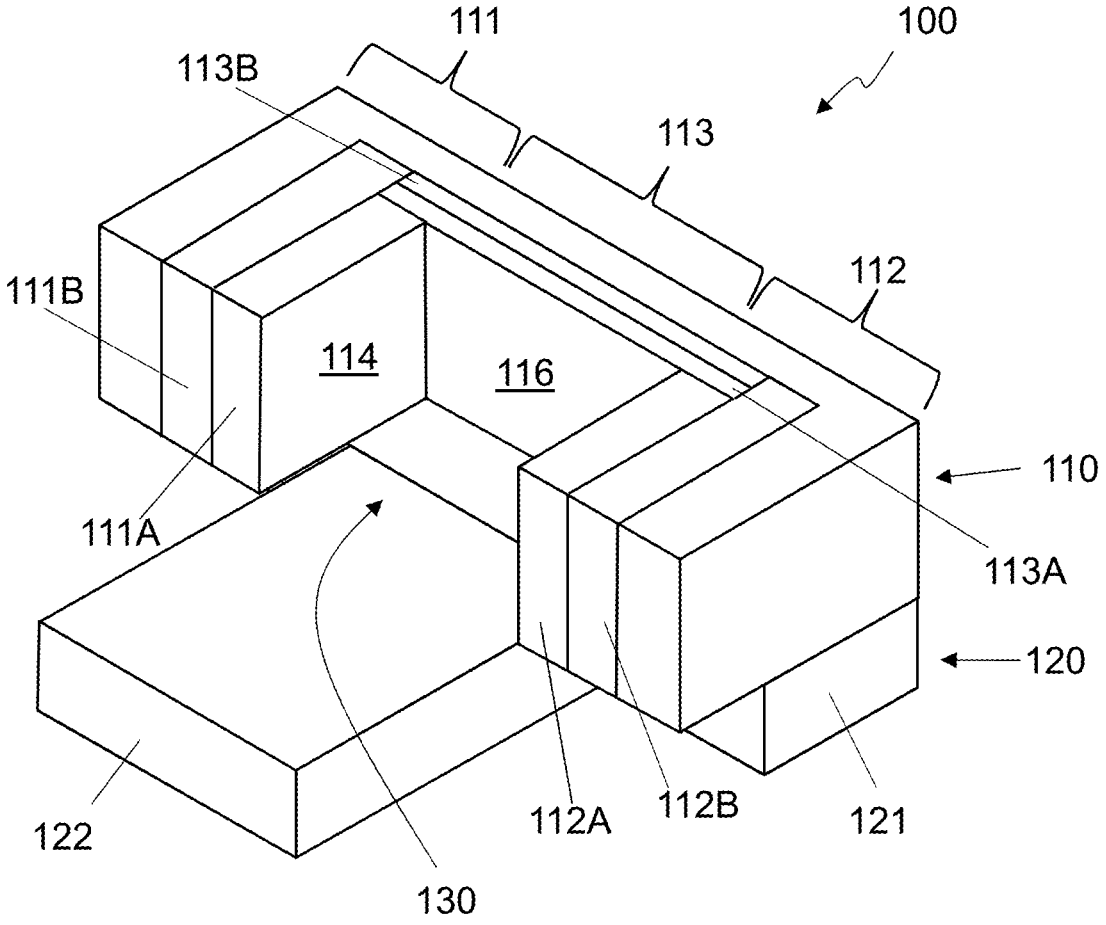
FIG. 1 shows an isometric view of a first embodiment of a modular packaging insert.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, and components have been described at a relatively high-level, without detail, in order to avoid unnecessarily obscuring aspects of the present concepts. A number of descriptive terms and phrases are used in describing the various embodiments of this disclosure. These descriptive terms and phrases are used to convey a generally agreed upon meaning to those skilled in the art unless a different definition is given in this specification.

As mentioned in the background section, the proper design of an overbox solution can be an effective way of shipping products with original packaging that is inadequate for standard ground and air shipment. Flat-panel televisions, for example, are fragile due to their large size and delicate components such as the large glass screen, but they are commonly shipped to retail in bulk using packaging that is not rated to protect the television if shipped individually by standard carriers. By positioning the television's original shipping carton inside a larger box using foam shipping inserts, the television can be safely shipped by standard carriers, but the overbox packaging solution needs to be adequately designed to pass industry standard package tests such as ISTA-3A published by the International Safe Transit Association. An 8 page overview of ISTA-3A is downloadable from https://www.ista.org/forms/3Aoverview.pdf and is incorporated by reference herein.

Because different televisions come in different sized boxes, traditionally, individual overbox solutions have been developed for each size of box. An overbox packaging system is described herein that uses a modular packaging insert adaptable to multiple sizes of high aspect ratio boxes using a common outer box and modular packaging insert. High aspect ratio, as the term is used herein and in the claims, means that one of the dimensions is less than 25% as long as either of the other two dimensions. The modular packaging insert is designed to be placed at the short edges of the high aspect ratio box and have a removable module that allows the remaining module to slide over the center area of the high aspect ratio box. The modular packaging insert is designed to fit over a first high aspect ratio box with a first width and be adaptable to fit over a second high aspect ratio box with a second width by removing one or more tear-away pieces of the modular packaging insert. The modular packaging insert also provides other tear-away pieces to adapt to changes in another dimension of the high aspect ratio box, such as length or height.

The modular packaging insert may be formed from any suitable material, but in some embodiments is formed using polyethylene open cell foam. The modular packaging insert may be fabricated from foam sheets, molded, extruded, or formed using any other appropriate manufacturing method or combination of methods. Different specific densities of polyethylene foam may be used for different embodiments, but in some embodiments a density of between 1 and 2 pounds per cubic foot may be used with at least one embodiment using a density of between 1.5 and 1.8 pounds per cubic foot. The thickness of the various parts of the modular packaging insert, including tear-away pieces, depends on the specific embodiment, but in at least one embodiment the foam thickness on each side of the inner box is between 0.75 inches and 4 inches. Various embodiments can be designed for various combinations of television sizes between 20 inches and 81 inches.

The exact dimensions of the outer box, as well as the specifications of the material used to fabricate the outer box, vary according to the embodiment, but in some embodiments the outer box is instructed using 44 ECT single wall corrugated cardboard. The outer box of the disclosed overbox packaging system can have top and bottom flaps that extend from the main box by an amount approximately equal to the width of the box. This causes the flaps to overlap when the outer box is closed and sealed with tape, increasing the strength of the outer box and making it better able to absorb impacts. The overbox packaging system uses plastic waterproof carton tape with a tensile strength of at least 22 pounds to seal the top flaps and bottom flaps of the outer box.

The outer box of some embodiments includes hand hold cutouts on the mid-line of the long side of the outer box. This makes it possible for one person to carry the box in many cases as even large flat-panel televisions are light enough to be lifted by a single person and providing centered hand hold cutouts balances the weight, making the large high aspect ratio box easier to handle.

Reference now is made in detail to the examples illustrated in the accompanying drawings and discussed below.

FIG. 1 shows an isometric view of a first embodiment of a modular packaging insert 100 for use in the overbox packaging system. The modular packaging insert 100 can be easily adapted to work with multiple different sizes of inner boxes by removing tear-away portions to match the width and another dimension of the inner box while still working with a common outer box. The modular packaging insert 100 includes a first module 110 and a second module 120 that are removably attached to each other. The first module 110 can be attached to the second module 120 by any appropriate mechanism, including, but not limited to, glue spots, heat-weld spots, or interlocking shapes. In some embodiments the first module 110 and the second module 120 may be fabricated from a single piece of material, and partial cuts made between the two modules 110, 120 allow them to be separated easily. While the two modules 110, 120 are attached to each other, they are easily separable from each other, and can be separated without the use of a tool in many embodiments. In most embodiments, no mechanism is provided to easily reattach the two modules 110, 120, although they could be re-glued or otherwise reattached if necessary. In various embodiments the modular packaging insert 100 may comprise, consist entirely of, or consist essentially of, a shock absorbing material, such as a closed or open cell foam material, a viscoelastic material, a rubberized fiber material, some other type of shock absorbing material, or a combination of different shock absorbing materials. Different types of foam materials may be used, including, but not limited to, polystyrene, polyurethane, or polyethylene foams.

The first module 110 includes a first substantially rectangular cuboid portion 111 positioned on a first end of the insert 100, a second substantially rectangular cuboid portion 112 positioned on a second end of the insert 100 opposite of the first end, and a third substantially rectangular cuboid portion 113 connected to the first portion 111 of the first module 110 and the second portion 112 of the first module 110. While the three portions 111, 112, 113 are referred to separately, in some embodiments they are fabricated from a single piece of material with no separation between the three portions 111, 112, 113. Also, while the portions 111, 112, 113 are referred to as being substantially rectangular cuboids, the actual fabricated shape may vary from that exact shape due to variations in material and/or manufacturing processes. For example, some materials, such as polyurethane foam, may be subject to cupping when cut, resulting in a concave surface instead of a flat surface. Also, manufacturing tolerances may result in angles that vary from 90° and dimensions that vary from those specified. In general, the shapes and surfaces of the various elements described herein can have a tolerance of up to 20% from the idealized shapes and dimensions provided and still be deemed to have the described characteristic.

The three portions 111, 112, 113 form a top surface of the first module 110 (facing away in FIG. 1 and not visible). The three portions 111, 112, 113 also form a slot 130 in a bottom of the first module 110 extending from a first side (the bottom in FIG. 1 which is not visible) of the first module 110 to the second side (the top surface shown in FIG. 1) of the first module 110 opposite of the first side. The slot 130 is defined by a first inner face 114 of the first portion 111 of the first module 110, a second inner face (not visible in FIG. 1) of the second portion 112 of the first module 110, and a third inner face 116 of the third portion 113 of the first module 113. The distance from the first inner face 114 to the second inner face defines a first width of the slot 130 and a distance from the third inner face 116 to the bottom (facing front-left in FIG. 1) of the first module 110 defines a first depth of the slot 130.

The first portion 111 of the first module 110 includes a first tear-away piece 111A that includes the first inner face 114. The first tear-away piece 111A is removably attached to a remaining section of the first portion 111 and configured to expose a first new surface of the first portion 111 of the first module 110 once the first tear-away piece 111A is removed. The first new surface is the surface of the fourth tear-away piece 111B to which the first tear-away piece 111A is removably attached. The first tear-away piece 111A can be attached to the rest of the first portion 111 by any appropriate mechanism, including glue spots, heat-weld spots, or interlocking shapes. In some embodiments the first tear-away piece 111A and the rest of the first portion 111 may be fabricated from a single piece of material, and partial cuts made between the first tear-away piece 111A and the rest of the first portion 111 allow them to be separated easily. While the first tear-away piece 111A and the rest of the first portion 111 are attached to each other, they are easily separable from each other. In some embodiments the first tear-away piece 111A is separable from the rest of the first portion 111 without the use of tools.

The second portion 112 of the first module 110 also includes a second tear-away piece 112A that includes the second inner face. The second tear-away piece 112A is removably attached to a remaining section of the second portion 112 and configured to expose a second new surface of the second portion 112 of the first module 110 once the second tear-away piece 112A is removed. The second new surface is the surface of the fifth tear-away piece 112B to which the second tear-away piece 112A is removably attached. A distance from the first new surface to the second new surface defines a second width of the slot 130. The second tear-away piece 112A can be attached to the rest of the second portion 112 by any appropriate mechanism, including glue spots, heat-weld spots, or interlocking shapes. In some embodiments the second tear-away piece 112A and the rest of the second portion 112 may be fabricated from a single piece of material and partial cuts made between the second tear-away piece 112A and the rest of the second portion 112 allow them to be separated easily. While the second tear-away piece 112A and the rest of the second portion 112 are attached to each other, they are easily separable from each other. In some embodiments the second tear-away piece 112A is separable from the rest of the second portion 112 without the use of tools.

The third portion 113 of the first module 110 includes a third tear-away piece 113A that includes the third inner face 116. The third tear-away piece 113A is removably attached to a remaining section of the third portion 113 and configured to expose a third new surface of the third portion 113 of the first module 110 once the third tear-away piece 113 is removed. The distance from the third new surface to the bottom of the first module 110 defines a second depth of the slot 130. The third tear-away piece 113A can be attached to the rest of the third portion 113 by any appropriate mechanism, including glue spots, heat-weld spots, or interlocking shapes. In some embodiments the third tear-away piece 113A and the rest of the third portion 113 may be fabricated from a single piece of material, and partial cuts made between the third tear-away piece 113A and the rest of the third portion 113 allow them to be separated easily. While the third tear-away piece 113A and the rest of the third portion 113 are attached to each other, they are easily separable from each other. In some embodiments the third tear-away piece 113A is separable from the rest of the third portion 113 without the use of tools.

In some embodiments the first portion 111 of the first module 110 also includes a fourth tear-away piece 111B that includes the first new surface. The fourth tear-away piece 111B is removably attached to a residual section of the first portion 111 and configured to expose a fourth new surface of the first portion 111 of the first module 110 once the fourth tear-away piece 111B is removed. The second portion 112 of the first module 110 may also include a fifth tear-away piece 112B that includes the second new surface. The fifth tear-away piece 112B is removably attached to a residual section of the second portion 112 and configured to expose a fifth new surface of the second portion 112 of the first module 110 once the fifth tear-away piece 112B is removed. The distance from the fourth new surface to the fifth new surface defines a third width of the slot 130.

In some embodiments the third portion 113 of the first module 110 also includes a sixth tear-away piece 113B that includes the third new surface. The sixth tear-away piece 113B is removably attached to a residual section of the third portion 113 and configured to expose a sixth new surface of the third portion 113 of the first module 110 once the sixth tear-away piece 113B is removed. The distance from the sixth new surface to the bottom of the first module 110 defines a third depth of the slot 130.

The second module 120 of the modular packaging insert 100 has a first thickness and is removably attached to the first side of the first module 110. The second module 120 covers at least a portion of one open side of the slot 130.

The second module 120 in some embodiments includes a first portion 121 and a second portion 122. The first portion 121 has the first thickness and a length extending from the first end of the first module 110 to the second end of the first module 110. The second portion 122 is attached to a first side of the first portion 121 of the second module 120 and extends out from the side of the first portion 121 of the second module 120 parallel to the first side of the first module 110. The second portion 122 of the second module 120 may have a width about equivalent to the first width of the slot 130, that being the distance from the first inner face 114 to the second inner face.

FIG. 2A-2D show plan views of a first module 110 of the first embodiment of the modular packaging insert 100 adapted for different sized inner boxes. The second module 120 is not shown for clarity, but could be attached or removed, depending on the use of the modular packaging insert 100.

Figure 2A:
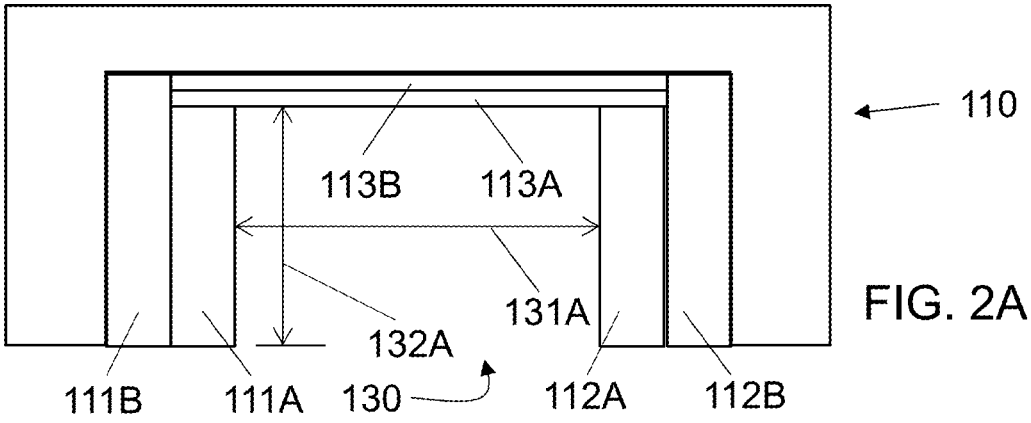
FIG. 2A-2D show plan views of a first module of the first embodiment of the modular packaging insert adapted for different sized inner boxes.

In FIG. 2A, no tear-away pieces 111A/B, 112A/B, 113A/B have been removed and the slot 130 has the first width 131A and the first depth 132A. This allows the modular packaging insert 100 to be used with a first inner box having a width about equal to the first width 131A and a second dimension (e.g. length) equal to a first amount.

Figure 2B:
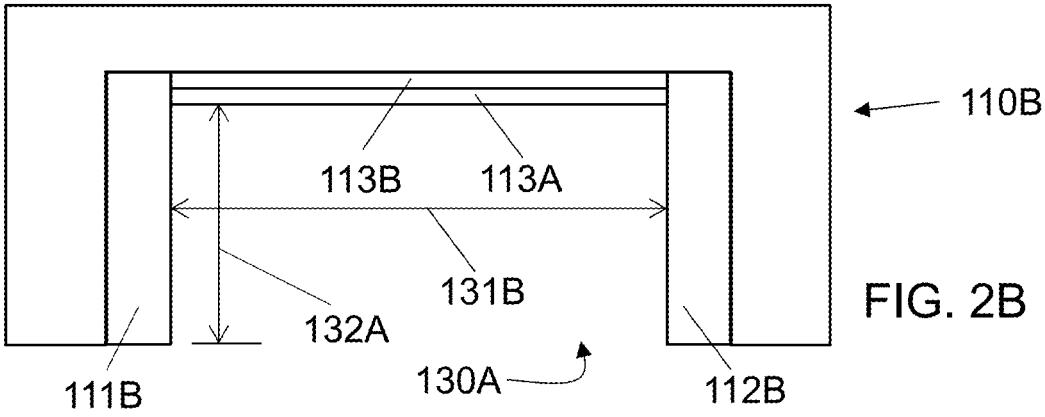

In FIG. 2B, first tear-away piece 111A and second tear-away piece 112A have been removed and the slot 130A has the second width 131B and the first depth 132A. This allows the modular packaging insert 100 to be used with a second inner box having a width about equal to the second width 131B and a second dimension (e.g. length) equal to the first amount.

Figure 2C:
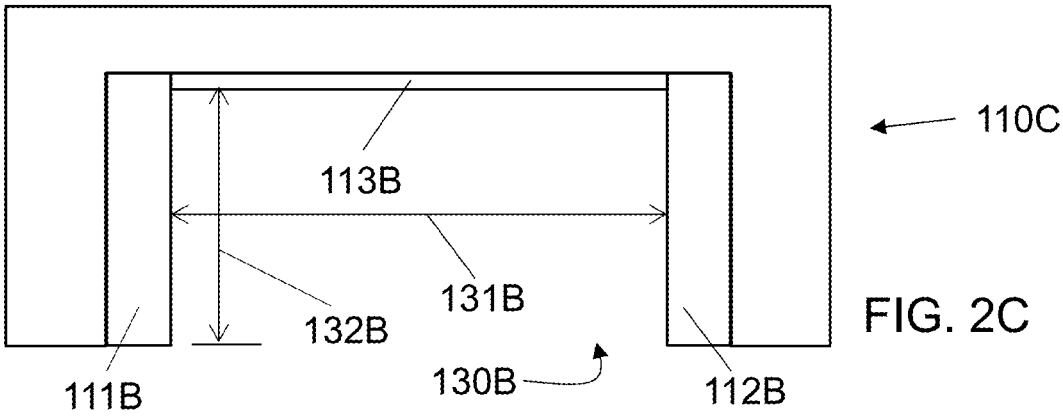

In FIG. 2C, the first tear-away piece 111A, second tear-away piece 112A, and third tear-away piece 113A have been removed and the slot 130B has the second width 131B and the second depth 132B. This allows the modular packaging insert 100 to be used with a third inner box having a width about equal to the second width 131B and a second dimension (e.g. length) equal to a second amount.

Figure 2D:
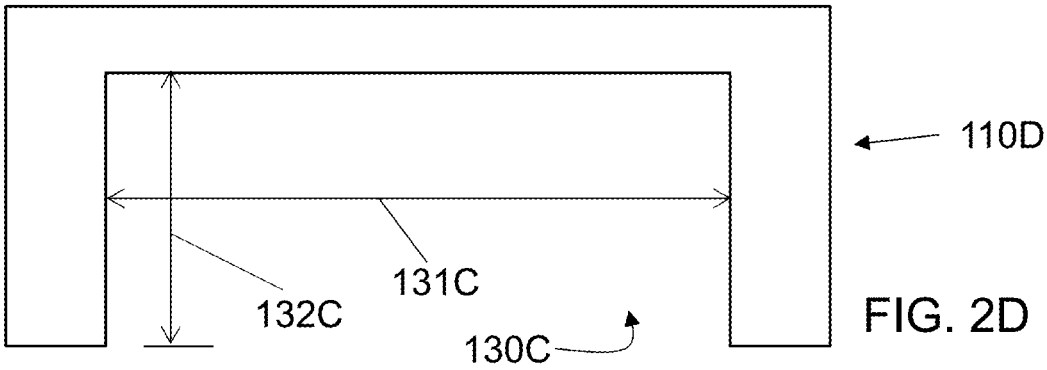

In FIG. 2D, the first tear-away piece 111A, second tear-away piece 112A, third tear-away piece 113A, fourth tear-away piece 111B, fifth tear-away piece 112B, and sixth tear-away piece 113B have been removed and the slot 130C has the third width 131C and the third depth 132C. This allows the modular packaging insert 100 to be used with a fourth inner box having a width about equal to the third width 131C and a second dimension (e.g. length) equal to a third amount.

Other combinations of tear-away pieces 111A/B, 112A/B, 113A/B may be removed to accommodate other sizes of inner boxes combined with various outer boxes. In some cases, the tear-away pieces may be removed asymmetrically. Other embodiments may have more or fewer tear-away pieces, and some embodiments may include tear-away pieces on the second module 120 to accommodate differences in the third dimension of the inner box.

Figure 3A:
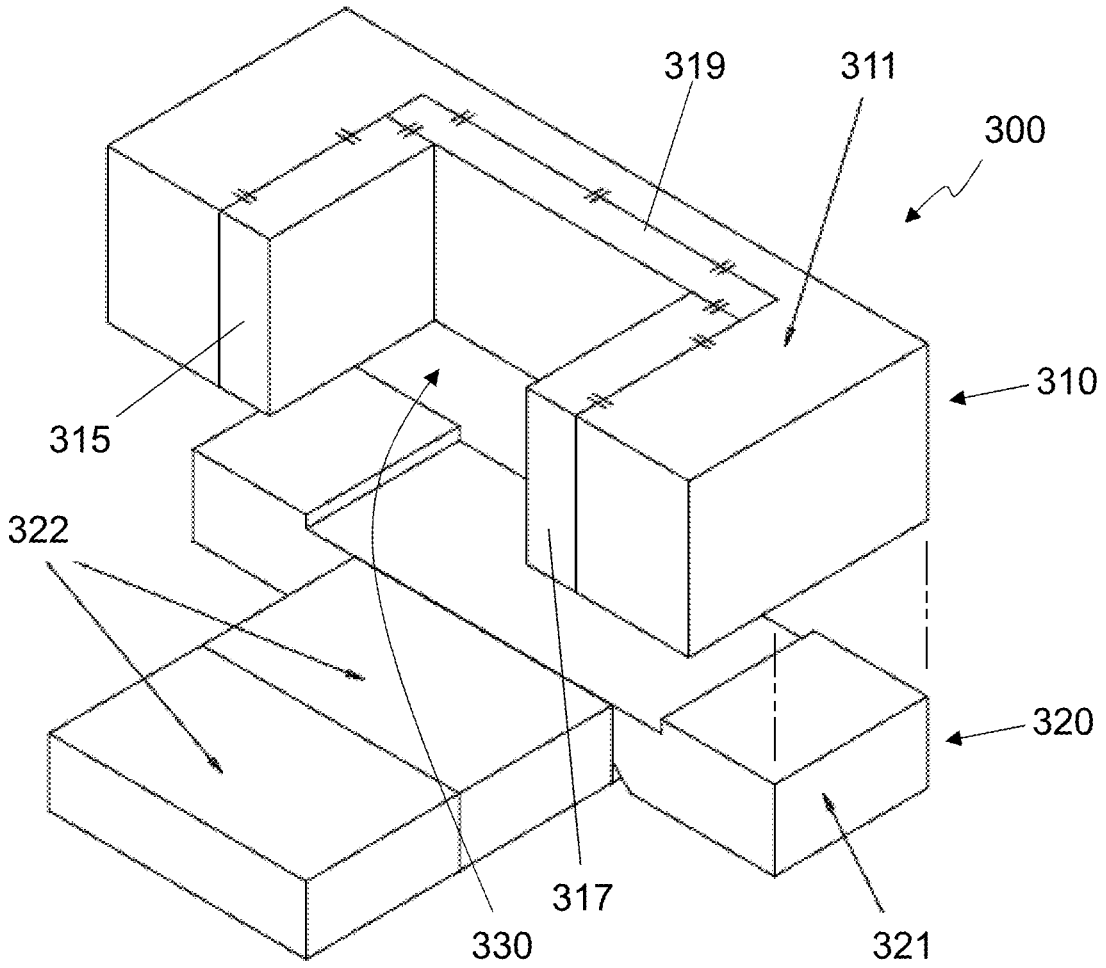
FIG. 3A shows an exploded isometric view of a second embodiment of a modular packaging insert.

FIG. 3A shows an exploded isometric view of a second embodiment of a modular packaging insert 300. The modular packaging insert 300 includes a first module 310 and a second module 320. FIG. 3A shows the two modules 310, 320 separated, but they are fabricated in such a way that they are removably attached to each other. The first module 310 is constructed similarly to the first embodiment of modular packaging insert 100, with a slot 330 adapted to slide over an inner box of an overbox packaging system. The first module 310 includes a first tear-away piece 315, a second tear-away piece 317, and a third tear-away piece 319. The slot 330 has a first width with the first tear-away piece 315 and second tear-away piece 317 in place, and a second width once the first tear-away piece 315 and second tear-away piece 317 removed. The slot 330 has a first depth with the third tear-away piece 319 in place and a second depth once the third tear-away piece 319 is removed.

Figure 3B:
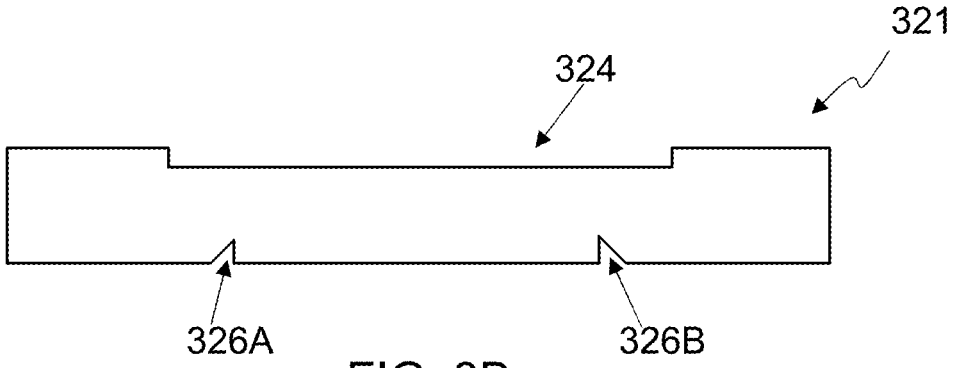
FIG. 3B shows an elevation view of a second module of the second embodiment of the modular packaging insert.

The second module 320 includes a first portion 321 and a second portion, with the second portion of this embodiment created by two pieces 322 bonded together and bonded to the first portion 321. The first portion 321 of the second module 320 has a length that approximately matches the length of the first module 310, and a first thickness. The first portion 321 can have various widths, depending on the embodiment, but in the embodiment shown, has a width that is about ⅔ of the first module. FIG. 3B shows an elevation view of the second module 321 of the second embodiment of the modular packaging insert 300. The first portion 321 of the second module 320 includes placement indentations 326A, 326B on a side opposite of the side which is removably attached to the first module 310. The placement indentations 326A, 326B are positioned to mark a position of attachment for the second portion of the second module 320.

The first portion 321 of the second module 320 includes a notch 324 on the side which is removably attached to the first module 310. The notch 324 extends from the first side of the first portion 321 of the second module 320 to a second side of the first portion 321 of the second module 320 opposite of the first side of the first portion 321 of the second module 320. The notch 324 can have a width equal to or greater than the first width of the slot 330, and depth of between 5% and 50% of the first thickness. In other embodiments, the notch 324 may have a width equal to the widest width of the slot 330 with tear-away pieces removed. In embodiments that include the notch, the second portion of the second module 120 may have a thickness about equal to the first thickness minus the depth of the notch 324.

The modular packaging insert 300 may be fabricated from any suitable material, with any suitable dimensions appropriate for the size of the inner box and the mass and fragility of its contents. In at least one embodiment consistent with FIG. 3A, the modular packaging insert 300 is fabricated from a 3 inch thick sheet of polyethylene open cell foam material with a density of between 1.5 and 1.8 pounds per cubic foot. The first module 310 has a length of 11.875 inches and the height of 4.875 inches. The first width of the slot 330 is 5.25 inches and the first depth of the slot 330 is 3.5 inches. The first, second, and third tear-away pieces 315, 317, 319 are formed by making cuts between the main portion of the first module 310 and tear-away pieces 315, 317, 319, leaving small uncut portions at the positions shown by the "=" marks. The small uncut portions can be of any width, but an uncut width of about 0.125 inches allows the tear-away pieces 315, 317, 319 to be easily removed by hand. The three tear-away pieces have a thickness of 0.75 inches so that the second width of the slot 330 is 7.25 inches and the second depth of the slot is 4.125 inches. The 3 inch sheet thickness sets the other dimension of the first module 310.

The second module 320 is formed from three pieces cut from the foam sheet. The first section 321 is formed from a 11.875×1.625 inch piece cut from the 3 inch thick sheet, and the two pieces 322 used to create the second section of the second module 320 use 5.25×1.375 inch pieces cut from the 3 inch thick sheet. The two pieces 322 may be cut from the material removed to make the slot 330 of the first module 310 to minimize the amount of material used to fabricate the modular packaging insert 300. This creates a first thickness of the second module 320 of 1.625 inches with the second section having a thickness of 1.375 inches and extending away from the first section 321 by 6 inches. The notch 324 has a width equal to the second width of the slot 330, 7.25 inches, and a depth of 0.25 inches. The second module 320 is formed by heat bonding the three separate pieces 321, 322, together, although other embodiments could use other methods to attach the pieces to each other. The first module 310 and the second module 320 are then removably attached using small heat bond areas, or small glue spots, with the pieces 322 of the second portion of the second module 320 covering one side of the slot 330.

Figure 4A:
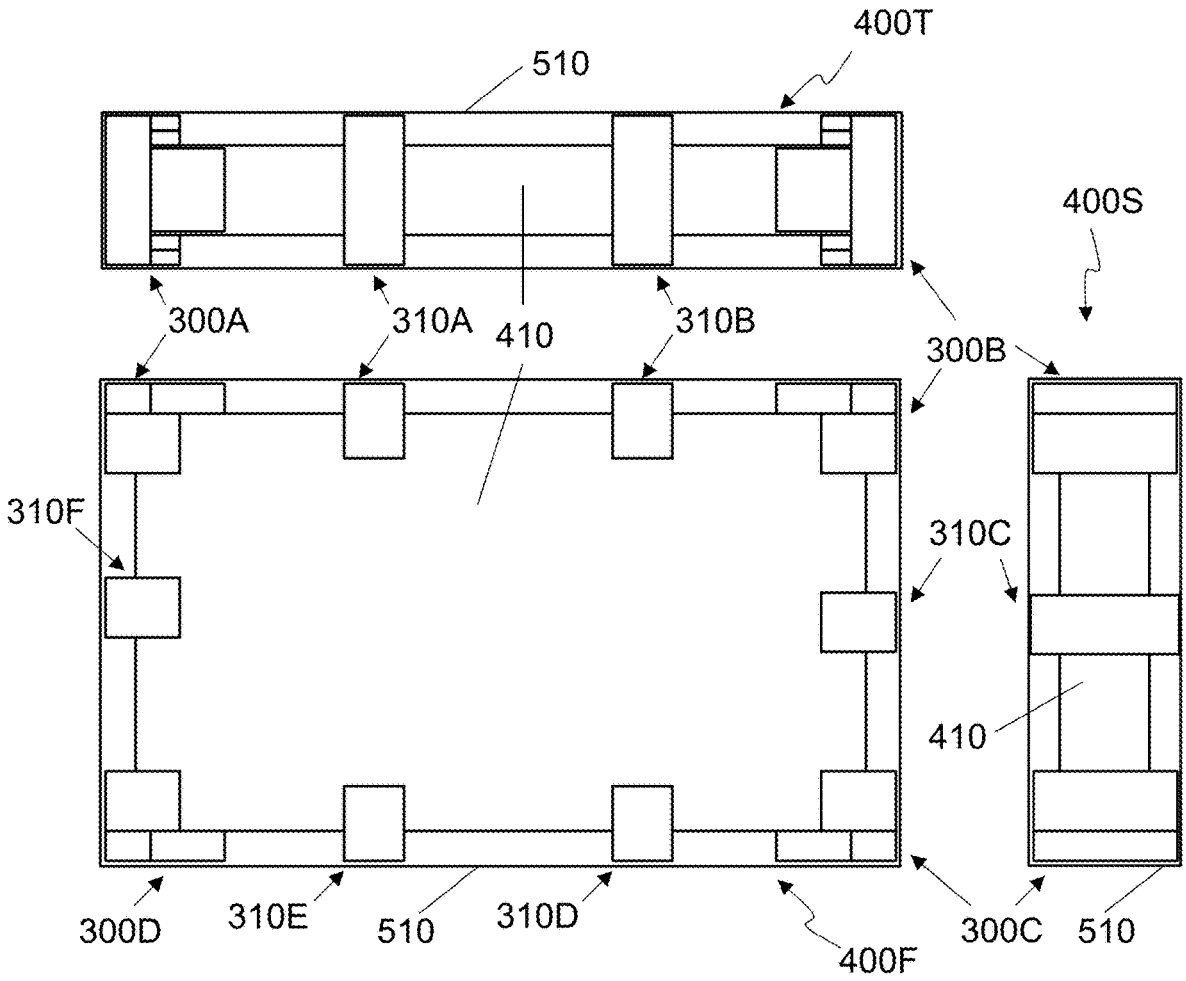
FIG. 4A shows a three view orthographic projection of an high aspect ratio inner box with multiple modular packaging inserts adapted to a first width inner box.

FIG. 4A shows a three view orthographic projection of a high aspect ratio inner box 410 with multiple modular packaging inserts adapted to a first width of the inner box 410. The first view 400T shows the high aspect ratio inner box 410 from the top, the second view 400F shows the high aspect ratio inner box 410 from the front, and the third view 400S shows the high aspect ratio inner box 410 from the side. The high aspect ratio inner box 410 is shown with multiple modular packaging inserts positioned around it for at least one embodiment of the overbox packaging system inside of the outer box 510. Note that a portion of the outer box 510 has been removed in each view 400T, 400F, 400S to allow the arrangement of the contents to be visible. The high aspect ratio inner box 410 has a width approximately equal to the first width of the slot 330 of the modular packaging insert 300, so no tear-away pieces are removed from the modular packaging inserts.

A first insert 300A is positioned over a first short edge of the inner box 410, a second insert 300B is positioned over a second short edge of the inner box 410, a third insert 300C is positioned over a third short edge of the inner box 410, and a fourth insert 300D is positioned over a fourth short edge of the inner box 410. The four inserts 300A, 300B, 300C, 300D position the inner box 410 in the slots of their first modules with their second modules positioned on the top or bottom surface of the inner box 410 to provide additional cushioning for the weight of the inner box 410.

In some embodiments of the overbox packaging system, additional modular packaging inserts are used by removing their second module. The first module's slot slides over the inner box 410 to provide additional cushioning. Any number of these additional first modules of the modular packaging inserts can be used, depending on the embodiment. FIG. 4A shows six additional first modules 310A, 310B, 310C, 310D, 310E, 310F positioned on the inner box 410.

In some embodiments the inner box 410 has a width that is slightly larger than the slot width of the inserts so that the insert stays in position as the inner box 410 is lowered into the outer box. In other embodiments the lower inserts 300C, 310D, 310E, 300D are positioned in the bottom of the outer box before the inner box 410 is lowered into the outer box and into those the slots of the lower inserts 300C, 310D, 310E, 300D. The rest of the inserts 300A, 310A, 310B, 300B, 310C, 310D are then put into position before the outer box is closed.

Figure 4B:
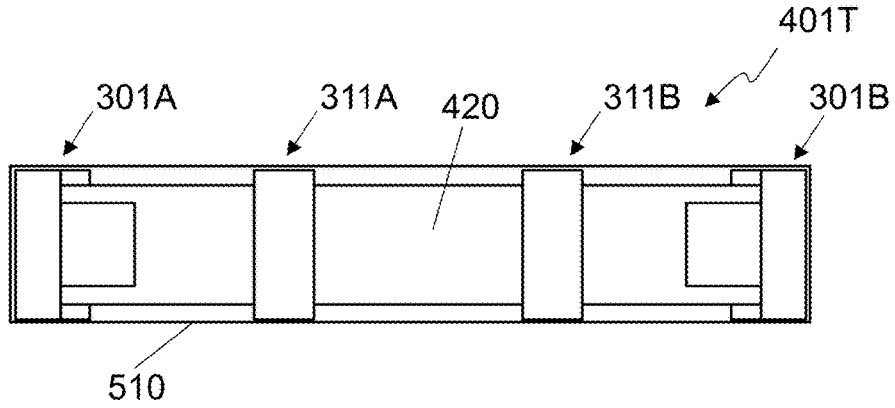
FIG. 4B shows a plan view of a different high aspect ratio inner box with modular packaging inserts adapted to a second width inner box.

FIG. 4B shows a plan view of a different, or second, high aspect ratio inner box 420 with modular packaging inserts adapted to a second width of the second inner box 420. The different inner box 420 has a second width that is approximately equal to the second width of the slot of modular packaging insert 300, so the first and second tear-away pieces 315, 317 are removed from the modular packaging inserts so that their slot fits over the second inner box 420. The top view 401T is shown, so only a first and second modular packaging insert with tear-away pieces removed 301A, 301B and third and fourth modular packaging insert with tear-away pieces removed and a second module removed 311A, 311B are visible. Depending on the length of the second inner box 410, the third tear-away pieces 319 of the modular packaging inserts may need to be removed to adjust the depth of the slot. The same outer box 510 is used as was used with the first inner box 410 as shown in FIG. 4A. Note that a portion of the outer box 510 has been removed in the view 401T to allow the arrangement of the contents to be visible.

Figure 5:
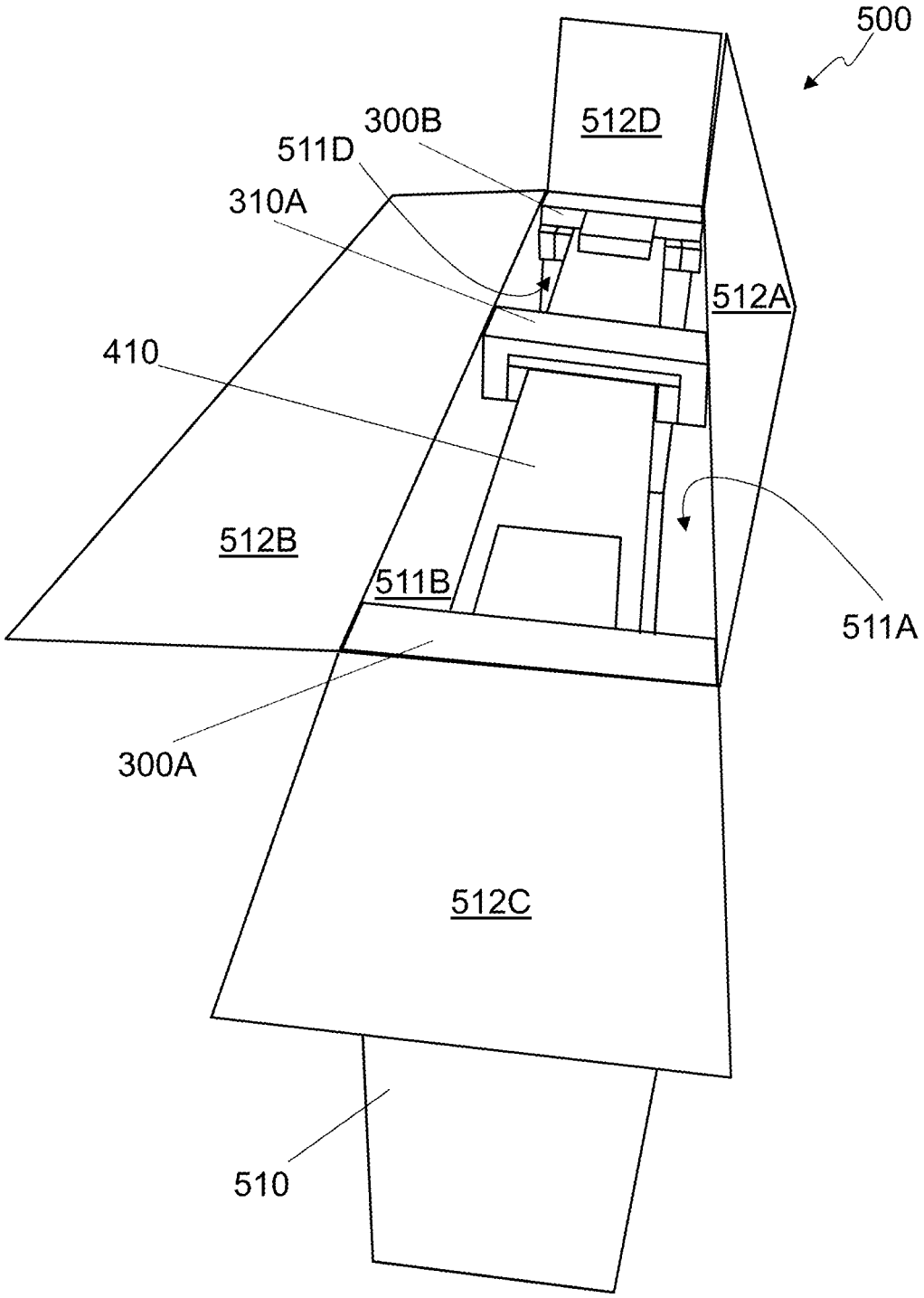
FIG. 5 shows an embodiment of the overbox packaging system.

FIG. 5 shows an embodiment of the overbox packaging system 500 with a high aspect ratio inner box 410. The overbox packaging system 500 includes an outer box 510 having a rectangular front inner surface 511A and a rectangular back inner surface 511B. Both the front and back inner surface 511A/B have an inner length and an inner height. The front inner surface 511A and the back inner surface 511B are connected to each other by a left inner side surface 511D and a right inner side surface (not visible), both with an inner width and the inner height. The outer box 510 also has four top flaps 512A, 512B, 512C, 512D and four bottom flaps that have a flap height that is approximately equal to the inner width of the outer box 510. In some embodiments, the outer box 510 also includes cut-outs sized to allow grip by a human hand on the mid-line of a front surface 511A. Additional hand-grip cutouts may also be provided in other embodiments.

Four modular packaging inserts, each having a width approximately equal to the inner width of the outer box 510, are positioned inside of the outer box 510 at top and bottom edges of the left side surface 511D and the right side surface, respectively, to hold a high aspect ratio inner box 410. A slot of the modular packaging inserts, including the top right insert 300A and top left insert 300B, are adapted to a width of the inner box 410 by selective removal of zero or more first tear-away pieces from each of the four modular packaging inserts and adapted to a second dimension of the inner box 410 by selective removal of zero or more second tear-away pieces of from each of at least two of the modular packaging inserts.

In some embodiments a fifth modular packaging insert 310A with a second module of the fifth modular packaging insert removed is also adapted to a width of the inner box 410 by selective removal of zero or more of the first tear-away pieces of a first module of the fifth modular packaging insert 310A. The first module of the fifth modular packaging insert 310A is positioned between two of the four modular packaging inserts to hold a section of the inner box 410.

In the overbox packaging system, a first piece of tape is adhered to at least one bottom flap and an outside surface of the outer box 510 to hold the four bottom flaps closed, and a second piece of tape is adhered to at least one top flap and the outside surface of the outer box 510 to hold the four top flaps 512A, 512B, 512C, 512D closed. In some embodiments, the first piece of tape and the second piece of tape both have a tensile strength of at least 22 lbs.

The overbox packaging system 500 in some embodiments is configured to pass a first ISTA-3 drop test with a first television having a first diagonal measurement in a first inner box 410 having a first width with no first tear-away pieces removed from the four modular packaging inserts, and to pass a second ISTA-3 drop test with a second television having a second diagonal measurement in a second inner box having a second width with the one or more first tear-away pieces removed from each of the four modular packaging inserts. The first diagonal measurement and the second diagonal measurement are both between 20 inches and 81 inches.

The outer box 510 may be constructed of any suitable material and may have any dimensions, but in at least one embodiment, the outer box 510 has inner dimensions of about 61×37×12 inches and is constructed with 44 ECT single-wall corrugated cardboard. Using the modular packaging insert 300 shown in FIG. 3A with the dimensions provided above and with no tear-away sections removed, an inner box 410 of 58×34.25×5.25 inches is protected by the overbox packaging system 500. If the first and second tear-away pieces 315, 317 are removed, an inner box 420 of 58×34.25×7.25 inches is protected by the overbox packaging system 500. If the first, second, and third tear-away pieces 315, 317, 319 are removed, an inner box of 59.5×34.25×7.25 inches is protected by the overbox packaging system 500. In some embodiments, different sized outer boxes may be used with the same type of modular packaging insert 300 to accommodate additional sizes of inner boxes.

Figure 6:
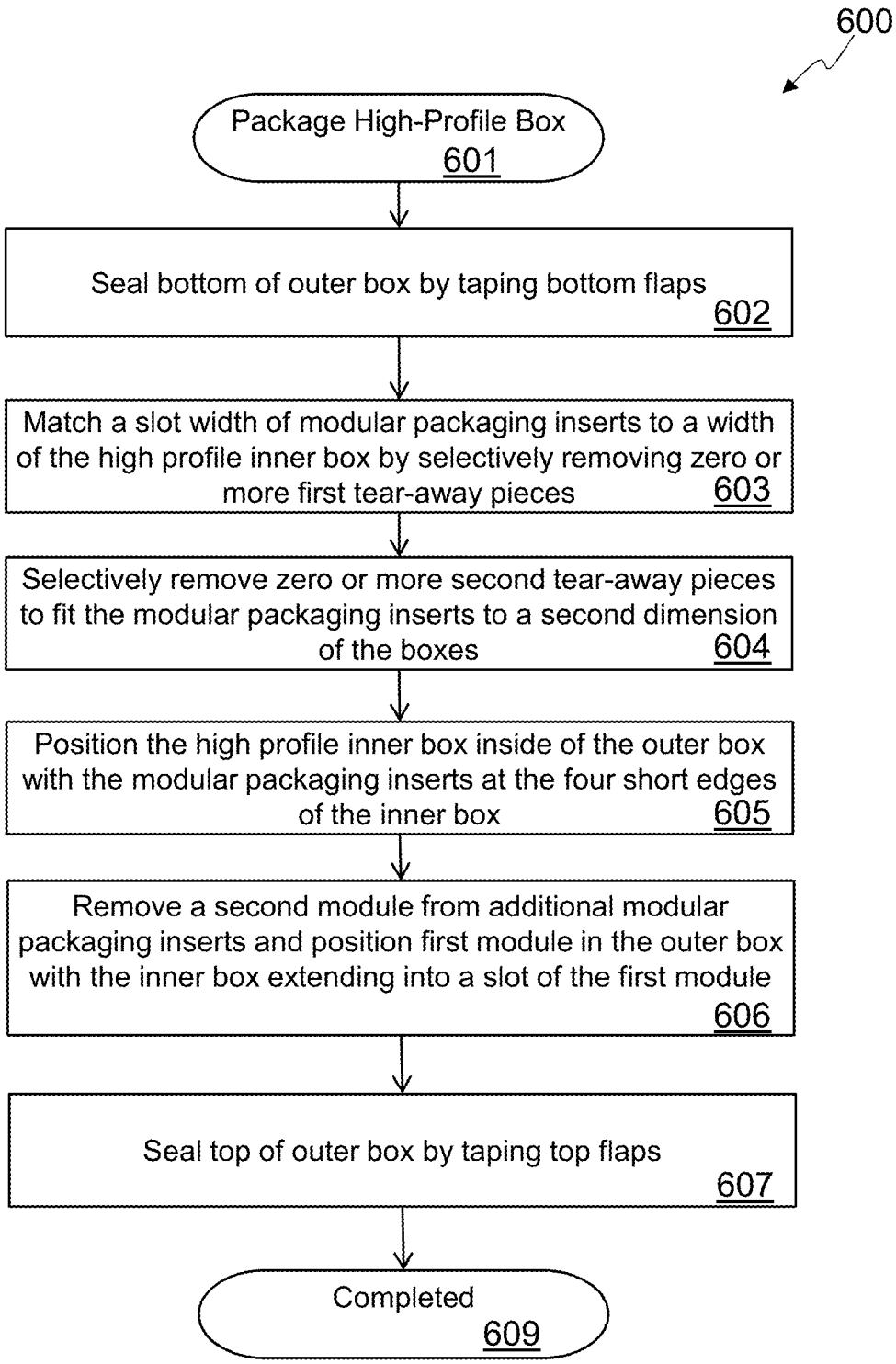
FIG. 6 is a flowchart of an embodiment of a method of packaging a high aspect ratio inner box for shipping.

FIG. 6 is a flowchart 600 of an embodiment of a method of packaging a high aspect ratio inner box for shipping. The method begins 601 and includes sealing 602 a bottom of an outer box by taping bottom flaps closed. The bottom flaps have a length about equivalent to a width of the outer box. A slot width of at least four modular packaging inserts is matched 603 to a width of the high aspect ratio inner box by selectively removing zero or more first tear-away pieces from the four modular packaging inserts. Zero or more second tear-away pieces are removed 604 from at least two of the four modular packaging inserts to fit the four modular packaging inserts between a second dimension of the high aspect ratio inner box and an second dimension of the outer box.

The method continues with positioning 605 the high aspect ratio inner box inside of the outer box with the four modular packaging inserts at the four short edges of the high aspect ratio inner box.

In some embodiments a second module of one or more additional modular packaging inserts is removed 606 to create open ends of a slot in a first module of the one or more additional modular packaging inserts. The first module of the one or more additional modular packaging inserts are then positioned in the outer box with the high aspect ratio inner box extending into the slot of the first module of the one or more additional modular packaging inserts.

A top of the outer box is sealed 607 by taping top flaps closed, and the method is completed 609. The top flaps have a length about equivalent to the width of the outer box.

Unless otherwise indicated, all numbers expressing quantities of elements, optical characteristic properties, and so forth used in the specification and claims are to be understood as being modified in all instances by the term "about." Accordingly, unless indicated to the contrary, the numerical parameters set forth in the preceding specification and attached claims are approximations that can vary depending upon the desired properties sought to be obtained by those skilled in the art utilizing various principles of the present disclosure. Recitation of numerical ranges by endpoints includes all numbers subsumed within that range (e.g. 1 to 5 includes 1, 2.78, π, and 5). As used in this specification and the appended claims, the singular forms "a", "an", and "the" include plural referents unless the content clearly dictates otherwise. Thus, for example, reference to an element described as "an opening" may refer to a single opening, two openings, or any other number of openings. As used in this specification and the appended claims, the term "or" is generally employed in its "and/or" inclusive sense, which includes the case where all the elements are included, unless the content clearly dictates otherwise. As used herein, the term "coupled" includes direct and indirect connections. Moreover, where first and second devices are coupled, intervening elements including active elements may be located there between. Any element in a claim that does not explicitly state "means for" performing a specified function, or "step for" performing a specified function, is not to be interpreted as a "means" or "step" clause as specified in 35 U.S.C. § 112(f).

The description of the various embodiments provided above is illustrative in nature and is not intended to limit the claims, their application, or their uses. Thus, different variations beyond those described herein are intended to be within the scope of the embodiments of the claims. Such variations are not to be regarded as a departure from the intended scope of the present disclosure. As such, the breadth and scope of the present disclosure should not be limited by the above-described exemplary embodiments, but should be defined only in accordance with the following claims and equivalents thereof.

What is claimed is:

1. A modular packaging insert comprising:

a first module comprising:

a first substantially rectangular cuboid portion positioned on a first end of the insert;

a second substantially rectangular cuboid portion positioned on a second end of the insert opposite of the first end; and a third substantially rectangular cuboid portion connected to the first portion of the first module and the second portion of the first module to form a top surface of the first module and to form a slot in a bottom of the first module extending from a first side of the first module to the second side of the first module opposite of the first side;

the slot defined by a first inner face of the first portion of the first module, a second inner face of the second portion of the first module, and a third inner face of the third portion of the first module, wherein a distance from the first inner face to the second inner face defines a first width of the slot and a distance from the third inner face to the bottom of the first module defines a first depth of the slot;

the first portion of the first module further comprising a first tear-away piece that includes the first inner face, the first tear-away piece removably attached to a remaining section of the first portion and configured to expose a first new surface of the first portion of the first module once the first tear-away piece is removed;

the second portion of the first module further comprising a second tear-away piece that includes the second inner face, the second tear-away piece removably attached to a remaining section of the second portion and configured to expose a second new surface of the second portion of the first module once the second tear-away piece is removed, wherein a distance from the first new surface to the second new surface defines a second width of the slot; and the third portion of the first module further comprising a third tear-away piece that includes the third inner face, the third tear-away piece removably attached to a remaining section of the third portion and configured to expose a third new surface of the third portion of the first module once the third tear-away piece is removed, wherein a distance from the third new surface to the bottom of the first module defines a second depth of the slot; and a second module having a first thickness, the second module removably attached to the first side of the first module and covering at least a portion of one open side of the slot.

2. The insert of claim 1, the first portion of the first module further comprising a fourth tear-away piece that includes the first new surface, the fourth tear-away piece removably attached to a residual section of the first portion and configured to expose a fourth new surface of the first portion of the first module once the fourth tear-away piece is removed; and the second portion of the first module further comprising a fifth tear-away piece that includes the second new surface, the fifth tear-away piece removably attached to a residual section of the second portion and configured to expose a fifth new surface of the second portion of the first module once the fifth tear-away piece is removed, wherein a distance from the fourth new surface to the fifth new surface defines a third width of the slot.

3. The insert of claim 1, the third portion of the first module further comprising a sixth tear-away piece that includes the third new surface, the sixth tear-away piece removably attached to a residual section of the third portion and configured to expose a sixth new surface of the third portion of the first module once the sixth tear-away piece is removed, wherein a distance from the sixth new surface to the bottom of the first module defines a third depth of the slot.

4. The insert of claim 1, the second module comprising:

a first portion having the first thickness and a length extending from the first end of the first module to the second end of the first module; and a second portion attached to a first side of the first portion of the second module and extending out from the side of the first portion of the second module parallel to the first side of the first module, the second portion of the second module having a width about equivalent to the first width of the slot.

5. The insert of claim 4, the second portion of the second module having the first thickness.

6. The insert of claim 4, the first portion of the second module including a notch on a side which is removably attached to the first module and extending from the first side of the first portion of the second module to a second side of the first portion of the second module opposite of the first side of the first portion of the second module, the notch having a width equal to or greater than the first width of the slot, and a depth of between 5% and 50% of the first thickness.

7. The insert of claim 6, the second portion of the second module having a thickness about equal to the first thickness minus the depth of the notch.

8. The insert of claim 4, the first portion of the second module including placement indentations on a side opposite of the side which is removably attached to the first module, the placement indentations positioned to mark a position of attachment for the second portion of the second module.

* * * * *